US007810888B2

(12) United States Patent
Clark et al.

(10) Patent No.: US 7,810,888 B2
(45) Date of Patent: Oct. 12, 2010

(54) PORTABLE ROCK CRUSHER AND SCARIFIER

(76) Inventors: Cedric J. Clark, 827 Meadowhurst Dr., St. Maries, ID (US) 83861; Cristan J. Clark, 625 E. Hattie, Coeur d' Alene, ID (US) 83814

( * ) Notice: Subject to any disclaimer, the term of this patent is extended or adjusted under 35 U.S.C. 154(b) by 361 days.

(21) Appl. No.: 12/070,978

(22) Filed: Feb. 22, 2008

(65) Prior Publication Data

US 2008/0203202 A1 Aug. 28, 2008

Related U.S. Application Data

(60) Provisional application No. 60/903,512, filed on Feb. 27, 2007.

(51) Int. Cl.
*E01C 19/05* (2006.01)

(52) U.S. Cl. ..... 299/39.4; 299/39.1; 299/37.5; 241/101.74; 241/101.75; 401/91

(58) Field of Classification Search ..... 299/39.4, 299/39.1, 37.5; 241/101.75, 101.74; 404/90–92
See application file for complete search history.

(56) References Cited

U.S. PATENT DOCUMENTS

| | | | | |
|---|---|---|---|---|
| 3,608,969 | A * | 9/1971 | Fowkes | 299/1.5 |
| 4,344,581 | A | 8/1982 | Redeman | |
| 4,607,799 | A | 8/1986 | Currie | |
| 4,717,083 | A | 1/1988 | Quast et al. | |
| 5,052,757 | A | 10/1991 | Latham | |
| 5,259,692 | A | 11/1993 | Beller et al. | |
| 5,695,255 | A | 12/1997 | LeBlond | |
| 5,697,562 | A * | 12/1997 | Leblond | 241/101.74 |
| 5,875,980 | A | 3/1999 | Schmid | |
| 5,899,535 | A | 5/1999 | LeBlond | |
| 6,299,082 | B1 | 10/2001 | Smith | |
| 6,832,818 | B2 | 12/2004 | Luciano | |
| 6,955,312 | B2 | 10/2005 | Beaulieu et al. | |
| 7,004,675 | B2 * | 2/2006 | Wayne | 404/91 |
| 7,144,087 | B2 * | 12/2006 | Haroldsen et al. | 299/39.1 |
| 7,357,595 | B1 * | 4/2008 | Pfaff | 404/92 |
| 2004/0021364 | A1 * | 2/2004 | Busley et al. | 299/39.4 |
| 2009/0051210 | A1 * | 2/2009 | Busley et al. | 299/39.4 |

* cited by examiner

*Primary Examiner*—Shane Bomar
(74) *Attorney, Agent, or Firm*—William A. Jeckle; Keith S. Bergman

(57) ABSTRACT

A portable rock crusher and scarifier for in-situ and on-site crushing, milling, grinding and preparation of road beds having a crusher frame defining a crusher channel journaling a reversibly rotatable arbor carrying plural automatically centering tooling implements in symmetrically spaced V-shaped axial keyways and a power pack releasably attachable to a road maintenance vehicle. An anvil weldment channel defined by spaced apart strongbacks communicates with the crusher channel and carries an adjustably positionable anvil weldment carrying two vertically spaced adjacent anvils proximate the arbor. A canting mounting structure provides attachment to a variety of road maintenance vehicles to provide carriage, support and movement. Milling implements may be installed on the arbor for grinding surfaces at depths below the crusher frame, and the crusher frame and power pack may be attached to a base for stationary operation.

18 Claims, 8 Drawing Sheets

PORTABLE ROCK CRUSHER AND SCARIFIER

RELATED APPLICATIONS

This application claims the benefit of earlier filed U.S. Provisional Application No. 60/903,512 filed on Feb. 27, 2007.

BACKGROUND OF INVENTION

1. Field of Invention

This invention relates to hard material disintegration machines, and more particularly to a portable rock crusher and scarifier having a rotating arbor adaptable to crush, grind, scarify and mill material in-situ and on-site for building, maintaining, and reconditioning roadways and for road site development.

2. Background and Description of Prior Art

Rock crushers and scarifiers are essential for building, maintaining and reconditioning roads but have various inherent drawbacks including rapid arbor and tooling implement wear, they are either mobile or stationary but are generally not operable in both configurations, they have limited tooling implement mounting patterns and they typically cannot mill surfaces to depths below the surrounding frame structure.

Stationary rock crushers, even those that are movable, require material be transported from a source to the rock crusher for crushing, and thereafter the finished product must be transported to a use site, usually with dump trucks and the like. Two way transport of the raw and finished material increases costs, decreases efficiency and requires additional road maintenance equipment.

Mobile rock crushers may have various configurations including large highly specialized machines that move on crawler tracks or on rubberized wheel assemblies, and smaller vehicle supported machines. Large mobile rock crushers typically carry a rotating arbor having a plurality of tooling implements thereon at a position between the crawler track assemblies and the arbor is generally permanently interconnected with an integral power source. Smaller vehicle supported rock crushers are known to have an integral power source forward of a rotating arbor which places the machine's center of gravity forwardly necessitating large support vehicles to counteract the weight and leading to limited operator visibility which increases risk of accidents and injury.

Known stationary rock crushers and known mobile rock crushers are designed for crushing fractureable material such as rock and gravel and the like but are not well suited for the milling operations without undergoing significant customization. Further, known stationary and mobile rock crushers typically have a fixed geometry that limits how the machine is used, what type of raw material may be crushed and the characteristics of the finished product, such as size.

What is needed is a portable rock crusher and scarifier that reclaims, recycles, converts and mills a wide variety of materials in-situ. The apparatus must be attachable to a variety of road maintenance vehicles and be able to effectively mill and plane asphalt, concrete, and bedrock, crush and pulverize rocky material, as well as scarify surfaces and prepare roadbeds. Further, because not all materials can be crushed, pulverized, milled, or ground in the same way, the apparatus must be easily adjustable and adaptable to the particular site needs by changing impact tooling, arbor rotation and product sizing distances.

Our portable rock crusher and scarifier overcomes various of the aforementioned drawbacks and resolves various of the aforementioned needs by providing a rock crusher and scarifier that may be used in both mobile and stationary operations.

Our portable rock crusher and scarifier has a crusher frame defining a feed inlet, a discharge outlet and a crusher channel extending therebetween. An anvil weldment channel communicating with the crusher channel carries an anvil weldment having two adjacent vertically spaced anvils to enhance durability and the anvil weldment is adjustably positionable in the anvil channel to regulate the size of finished product. A rotating arbor defining plural "V" shaped axial keyways for mounting tooling implements is journaled by the crusher frame and extends transversely across the crusher channel. The arbor keyways each define plural spacedly arrayed threaded holes to engage with threaded connectors extending through the tooling implements and radially into the arbor. A power pack releasably connected to the crusher frame and operatively communicating with the arbor is carried spacedly rearward above the arbor to move the center of gravity rearward and improve operator visibility. Our portable rock crusher and scarifier is releasably mountable to a variety of road maintenance vehicles which provide the required forward movement to force-feed the rock crusher position the rock crusher and scarifier in an orientation allowing an operator to access and maintain the arbor as well as change tooling implements on-site, to adapt the rock crusher and scarifier to the on-site material being recycled and reclaimed. A canting mounting structure between the carrying vehicle and the power pack allows our rock crusher and scarifier to be canted, during operation, to maintain the side-to-side angulation of a roadway relative to horizontal which is known in the industry as the "super elevation" or "super" of the roadway.

Our invention does not reside in any one of the identified features individually but rather in the synergistic combination of all of its structures, which give rise to the functions necessarily flowing therefrom as hereinafter specified and claimed.

SUMMARY

A portable rock crusher and scarifier generally provides a crusher frame defining a crusher channel with a feed inlet, a discharge outlet and an anvil weldment channel carrying a height adjustable anvil weldment with plural anvils, and journaling a reversibly rotatable arbor defining plural symmetrically spaced axial keyways for releasable radial mounting of tooling implements. A power pack having an engine and a hydraulic pump is operatively connected to the arbor and a canting mounting structure releasably attaches the portable rock crusher and scarifier to a road maintenance vehicle.

In providing such an apparatus it is:

a principal object to provide such a portable rock crusher and scarifier for in-situ crushing, grinding, pulverizing, milling, reclamation and recycling of materials for building, maintaining and restoring roadways and for the preparation of roadbeds.

a further object to provide such a portable rock crusher and scarifier that is adjustable in geometry, speed and tooling to adapt to the on-site material being recycled and reclaimed.

a further object to provide such a portable rock crusher and scarifier having a reversible rotatable arbor defining plural symmetrically spaced "V" shaped axial keyways to automatically center and retain tooling implements.

a further object to provide such a portable rock crusher and scarifier having an arbor defining a plurality of spacedly arrayed threaded radial blind holes in the arbor keyways for mounting various patterns and configurations of tooling implements.

a further object to provide such a portable rock crusher and scarifier having a power pack carried rearward of the crusher frame to increase operator visibility, to move the center of gravity rearward and to allow carriage by a variety of road maintenance vehicles.

a further object to provide a portable rock crusher and scarifier that may be used in both mobile and stationary configurations.

a further object to provide such a portable rock crusher and scarifier defining an anvil weldment channel communicating with the crusher channel and carrying an adjustably positionable anvil weldment having plural anvils.

a further object to provide such a portable rock crusher and scarifier having a power pack that is adjustably positionable relative to the crusher frame and removable therefrom.

a further object to provide such a portable rock crusher and scarifier for tooling implements that extend below the crusher frame for milling, planning and scarifying to depths below the crusher frame.

a further object to provide such a portable rock crusher and scarifier that produces quality aggregate from a wide range of materials that exist on-site.

a further object to provide such a portable rock crusher and scarifier that is adaptable to grind, mill and plane road surfaces and roadbeds.

a further object to provide such a portable rock crusher and scarifier having a canting mounting structure for maintaining the super of the roadway.

a further object to provide such portable rock crusher and scarifier that may be force-fed and be gravity fed.

a still further object to provide such a portable rock crusher and scarifier that is of new and novel design, of rugged and durable nature, of simple and economic manufacture and one that is otherwise well suited to the uses and purposes for which it is intended.

Other and further objects of our invention will appear from the following specification and accompanying drawings which form a part hereof. In carrying out the objects of our invention it is to be understood that its structures and features are susceptible to change in design and arrangement with only one preferred and practical embodiment of the best known mode being illustrated in the accompanying drawings and specified as is required.

BRIEF DESCRIPTIONS OF DRAWINGS

In the accompanying drawings which form a part hereof and wherein like numbers refer to similar parts throughout:

DESCRIPTION OF PREFERRED EMBODIMENT

Figure 1:
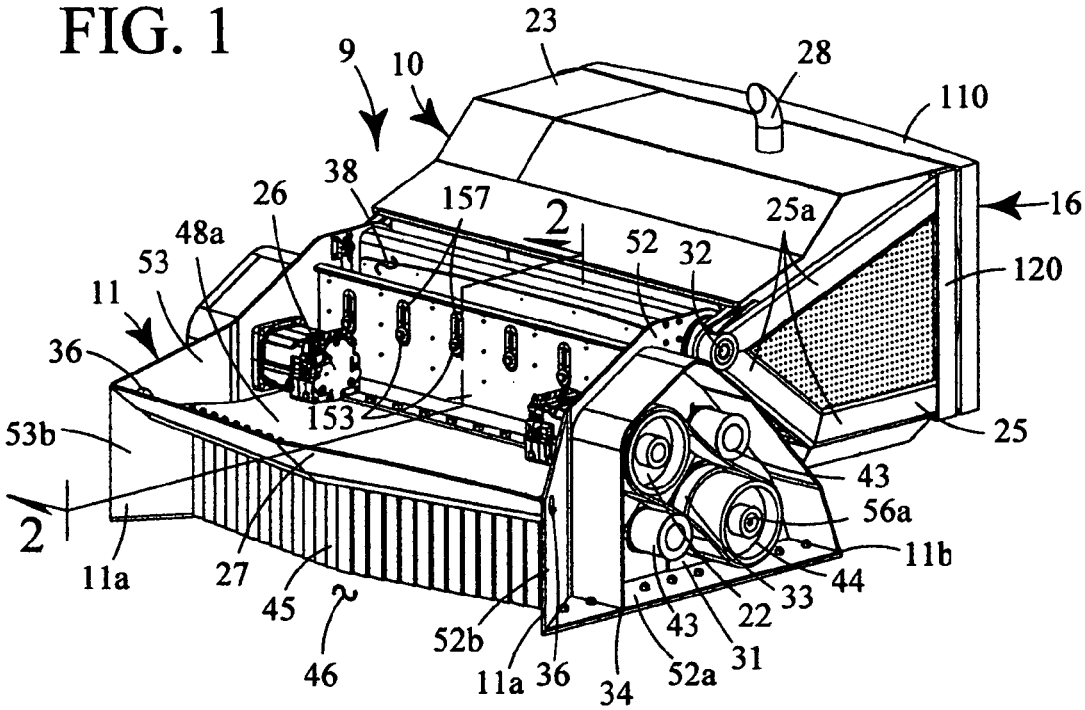
FIG. 1 is an isometric front top and left side view of our portable rock crusher and scarifier with belt guard removed to show the belt drive assembly.

As used herein, the term "bottom", its derivatives, and grammatical equivalents refers to the portion of our portable rock crusher and scarifier that is closest to a supporting surface, such as a road bed. The term "top", its derivatives, and grammatical equivalents refers to the portion of our portable rock crusher and scarifier that is most distant from the supporting surface. The term "rearward", its derivatives, and grammatical equivalents refers to the portion of our portable rock crusher and scarifier that is closest to a carrying vehicle. The term "forward", its derivatives, and grammatical equivalents refers to the portion of our portable rock crusher and scarifier that is most distant from the carrying vehicle. The term "outer", its derivatives, and grammatical equivalents refers to a side portion of our portable rock crusher and scarifier as opposed to a laterally medial portion.

Our portable rock crusher and scarifier 9 generally provides canting mounting structure 16 carrying power pack 10 that is releasably attachable to crusher frame 11 journaling rotatable arbor 12 having plural tooling implements 13.

Figure 18:
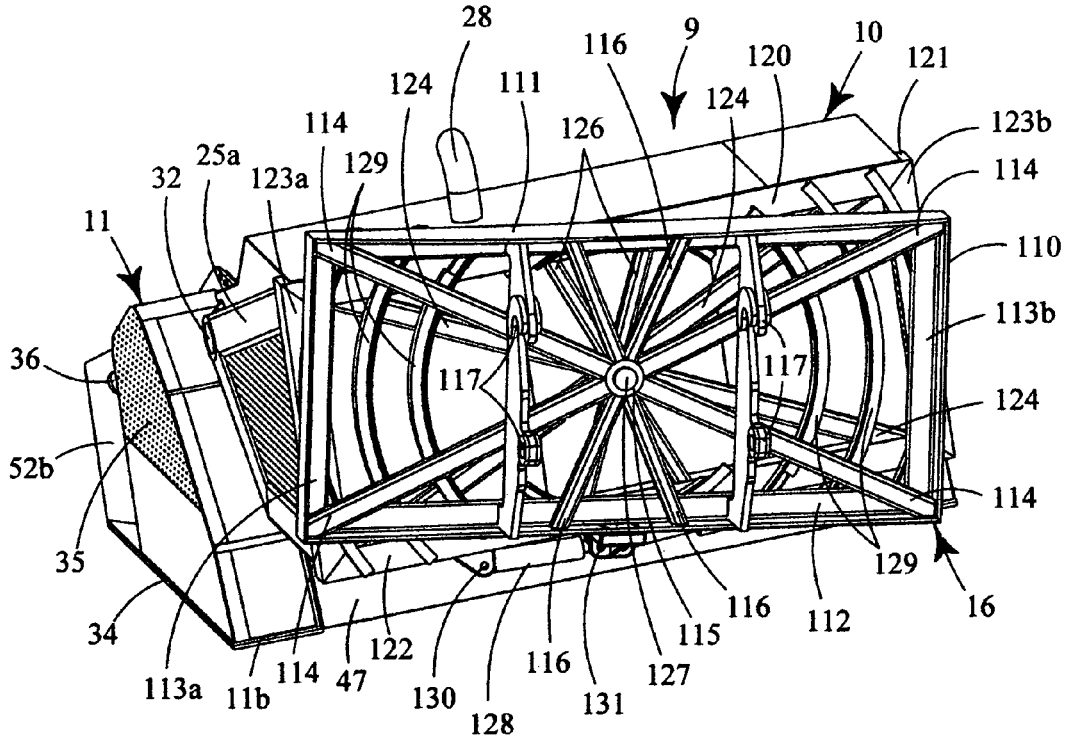
FIG. 18 is an orthographic back, top and left side view of our canting mounting structure attached to the powerpack.

The canting mounting structure 16 (FIG. 18) is generally rectilinear and has a primary frame 110 pivotally attached to forwardly adjacent secondary frame 120 by axle 127 communicating therebetween.

Figure 19:
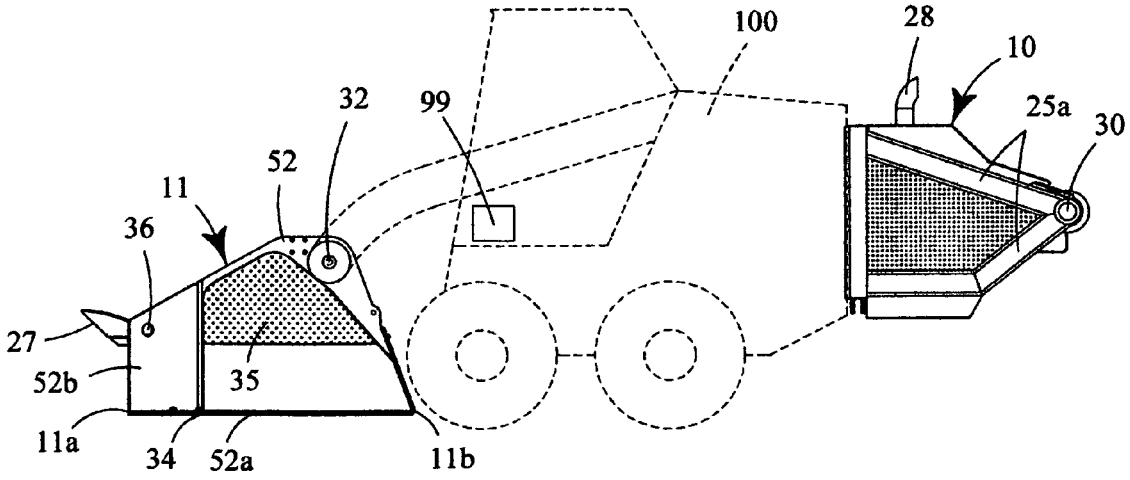
FIG. 19 is an orthographic right side view of the power pack carried at the rearward end portion of a skid steer vehicle and the crusher frame carried at the forward end portion of the skid steer vehicle.
Figure 20:
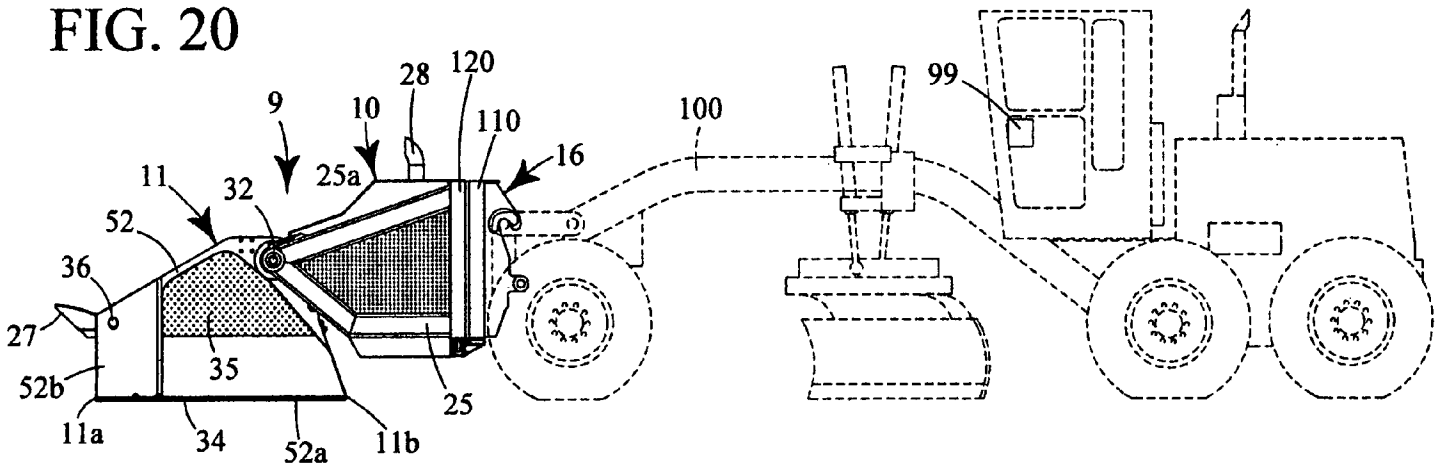
FIG. 20 is an orthographic left side view of our portable rock crusher and scarifier carried at the forward end portion of a road grader.
Figure 21:
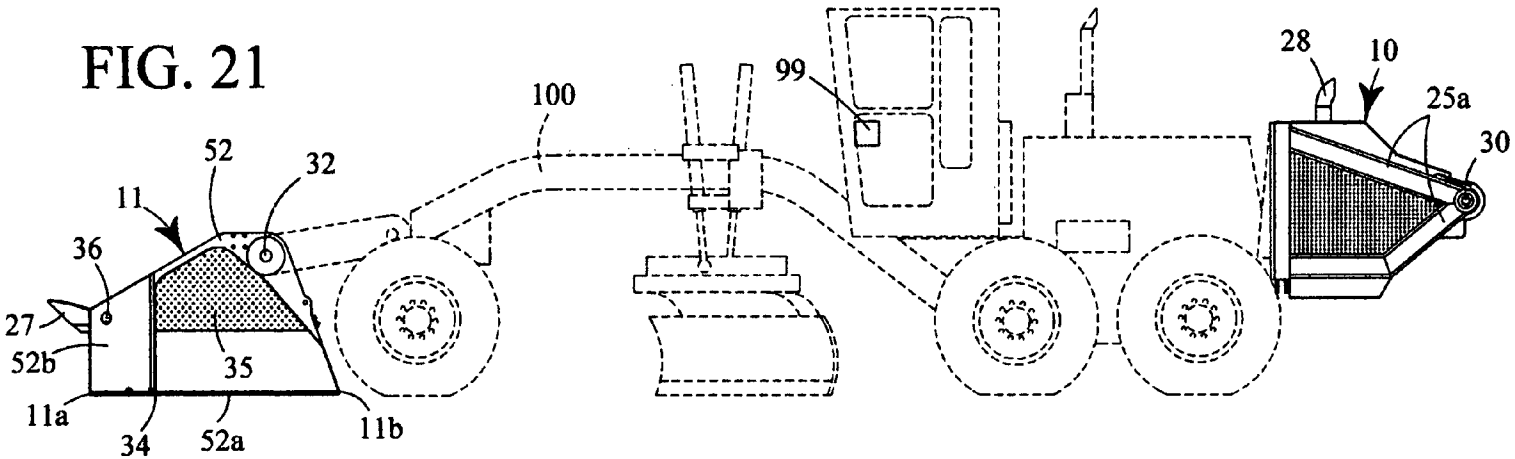
FIG. 21 is an orthographic left side view of the power pack carried at the rearward end portion of a road grader and the crusher frame carried at the forward end portion of the road grader.

The primary frame 110 is formed of end-to-end interconnected steel beams and has a top portion 111, a bottom portion 112, and two spaced apart side portions 113*a*, 113*b*. Reinforcing beams 114 extend from upper lateral corner to the opposing lower lateral corner adding structural rigidity to the primary frame 110. The reinforcing beams 114 intersect at medial hub 115 where the forwardly extending axle 127 is carried. Secondary supports 116 extend radially from the hub 115 and communicate with the top portion 111 and bottom portion 112. Carrying vehicle mounts 117 are structurally carried by the primary frame 110 opposite the secondary frame 120 and extend from the top portion 111 to the bottom portion 112 providing a releasable means for attachment to a carrying vehicle 100 such as a skid steer vehicle (FIG. 19) and a road grader. (FIGS. 20, 21).

The secondary frame 120 is similarly formed of end-to-end interconnected steel beams and has a top portion 121, a bottom portion 122, and two spaced apart side portions 123*a*, 123*b*. Reinforcing beams 124 extend from upper lateral corner to the opposing lower lateral corner adding structural rigidity to the secondary frame 120. The reinforcing beams 124 intersect at a medial hub (not shown) where the forwardly extending axle 127 engages with the secondary frame 120. Secondary supports 126 extend radially from the medial hub (not shown) and communicate with the top portion 121 and bottom portion 122.

Plural horizontally spaced intermeshing opposing arcuate supports 129 are structurally carried on the forward portion of the primary frame 110 and on the rearward portion of the secondary frame 120 extending from the top portions 111, 121 to the bottom portions 112, 122 respectively. The intermeshing arcuate supports 129 provide additional strength to the interconnection of the primary frame 110 and the secondary frame 120 while allowing the primary frame 110 and the secondary frame 120 to pivot relative to one another about the axle 127.

Hydraulic cylinder 128 communicates with the primary frame 110 and the secondary frame 120 at the bottom portions 112, 122, respectively thereof and operatively communicates with hydraulic pump 23 with known hoses and fittings (not shown). One end portion of the hydraulic cylinder 128 is pivotally interconnected to cylinder bracket 130 structurally carried by the secondary frame 120, and the opposing end portion of hydraulic cylinder rod (not shown) is pivotally interconnected to piston rod bracket 131 structurally carried by the primary frame 110. Extension and retraction of the hydraulic cylinder rod (not shown) cants the secondary frame 120, relative to the primary frame 110 about the axle 127. The canting of the portable rock crusher and scarifier 9 allows an operator to ensure the super of the roadway is maintained as the crushing, grinding, recycling and reclamation operation is ongoing. The canting of the portable rock crusher and scarifier 9 also enables an operator to prevent material from escaping crushing due to unintended excessive lean of the crusher frame 11 which may be caused by excess material agglomerating under one side portion of the crusher frame 11.

The power pack 10 comprises a U-shaped power pack frame 25 of plural structurally interconnected box beams and has a back portion and two spaced apart forwardly extending side portions 25*a*, 25*b* supporting an internal combustion engine 28 mechanically communicating with a hydraulic pump 23 by known means. In the preferred embodiment, the back portion of the powerpack frame 25 is the secondary frame 120 of the canting mounting structure 16. In an alternative embodiment (not shown), the back portion of the powerpack frame 25 may be a separate structure (not shown) directly connected to forward portion of the secondary frame 120.

Figure 14:
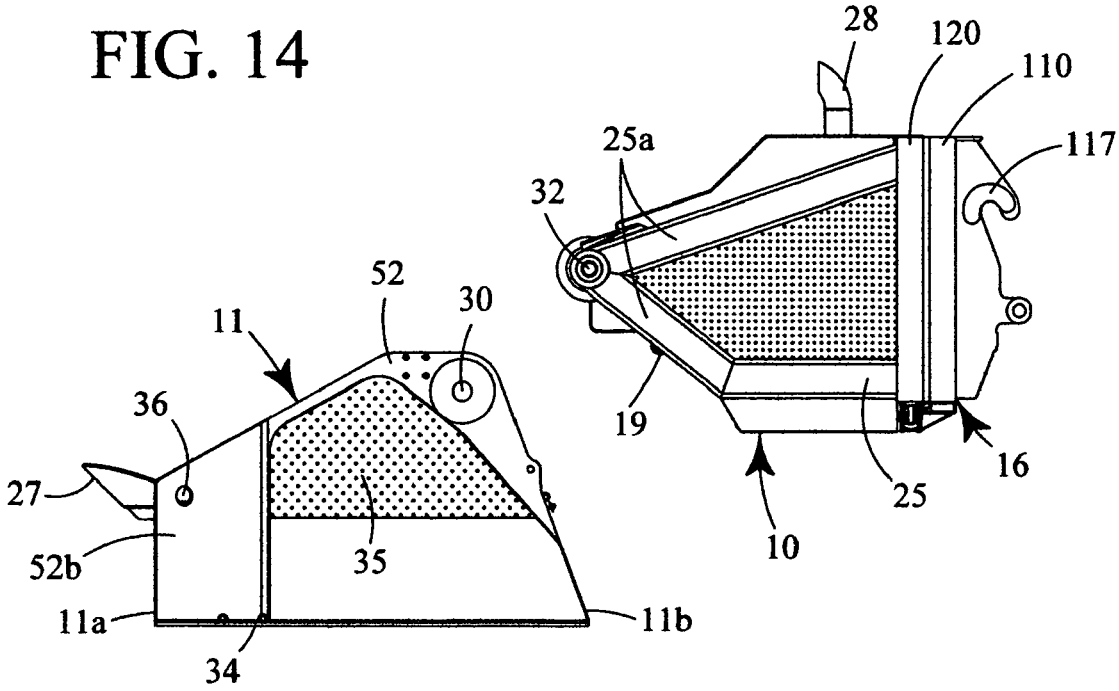
FIG. 14 is an orthographic left side view of the power pack and the crusher frame detached from one another.
Figure 15:
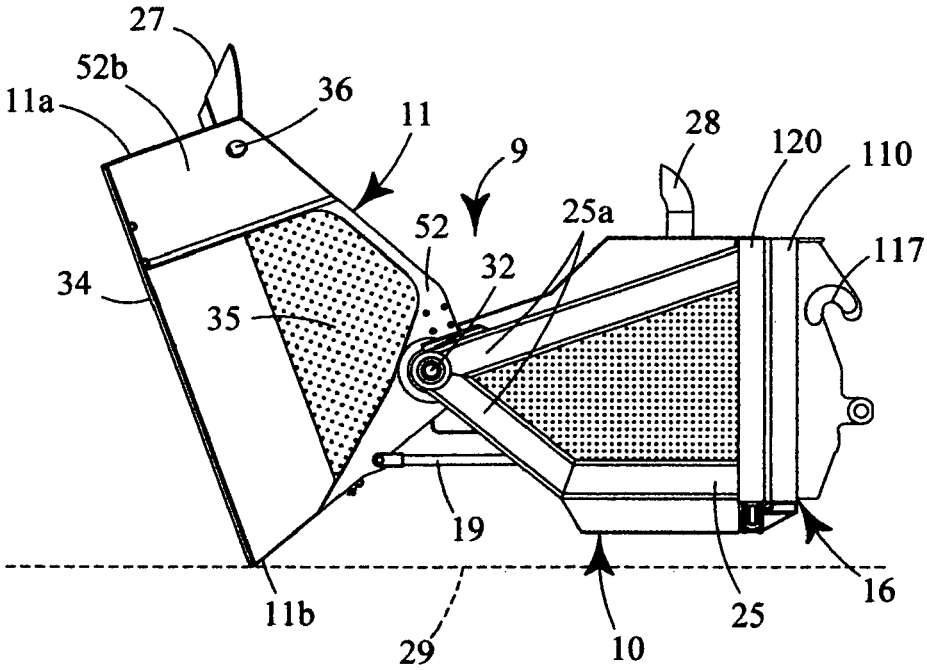
FIG. 15 is an orthographic left side view similar to that of FIG. 14 showing the power pack and the crusher frame interconnected with the crusher frame rotated upwardly and resting on a supporting surface allowing access to the arbor for maintenance and tooling changes.
Figure 16:
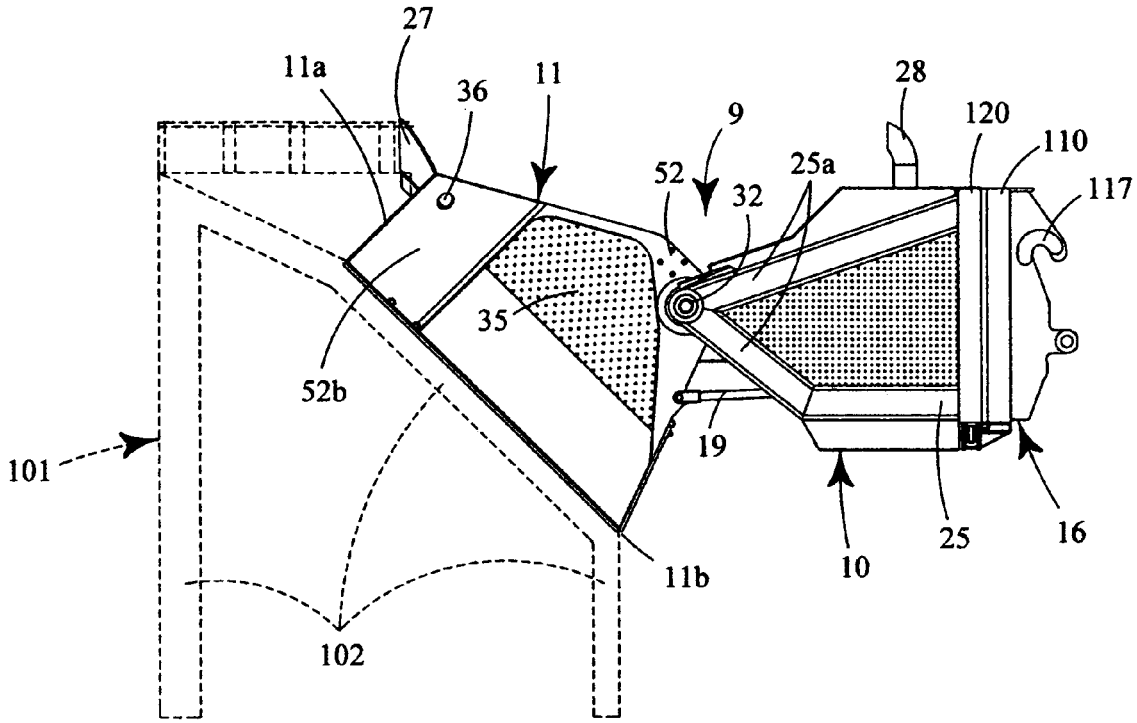
FIG. 16 is an orthographic left side view of the power pack and crusher frame supported on a base for stationary operation with gravity feed.

The power pack 10 is releasably attachable to upper rearward portion of the crusher frame 11 with releasable fasteners 32 extending through aligned holes 30 defined in the power pack frame side portions 25*a*, 25*b*, opposite the secondary frame back portion 120, and also defined in first and second side portions 52, 53 respectively of the crusher frame 11. The releasable fasteners 32 allow the power pack 10 to be detached from the crusher frame 11 (FIG. 14) as well as angularly positioned relative to the crusher frame 11 for stationary use (FIG. 16) and for maintenance (FIG. 15). Hydraulic cylinders 19 having axially extendable piston rods operatively communicate between each power pack frame side portion 25*a*, 25*b* and medial rearward positions of the first and second side portions 52, 53 of the crusher frame 11 providing powered rotation of the crusher frame 11 relative to the power pack 10. (FIG. 15). The hydraulic cylinders 19 also strengthen the interconnection of the power pack 10 to the crusher frame 11 and prevent inadvertent rotation therebetween as the crusher frame 11 is force-fed by forward movement.

The crusher frame 11 is formed of steel plates and has a first side portion 52, a spaced apart parallel second side portion 53, a forward roof portion 48*a*, a rearward roof portion 48*b* and two spaced apart strongbacks 63, 64 perpendicular to the side portions 52, 53 and perpendicular to the roof portions 48*a*, 48*b* defining an anvil weldment channel 38 therebetween. The forward roof portion 48*a*, the strongbacks 63, 64 and the first and second side portions 52, 53 are structurally interconnected at adjoining edge portions such as by welding. The rearward roof portion 48*b* may be interconnected to the first and second side portions 52, 53 respectively and strong back 64 along adjacent edge portions by welding or may be secured thereto with removable pin-type fasteners (not shown). Crusher channel 51 extending from feed inlet 46 at forward end portion 11*a* to discharge outlet 47 at rearward end portion 11*b* is defined by the first and second side portions 52, 53 below the forward and rearward roof portions 48*a*, 48*b* respectively.

Each side portion 52, 53 structurally carries a reinforcing plate 31 on a side opposite the crusher channel 51 to support an arbor bearing mount 33. Skid plates 34 releasably fastened to bottom edge portions 52*a*, 53*a* provide a durable replaceable wear surface. Forward edge portions 52*b*, 53*b* of each side portion 52, 53 flare outwardly and work cooperatively with a forwardly inclined baffle 27 to direct material into the feed inlet 46. The baffle 27 and leading edge of the forward roof portion 48*a* form a somewhat pointed "bow" for the crusher frame 11 above the feed inlet 46 that assist an operator in maintaining a proper path of travel along a linear pile of material being recycled. Debris scuppers 36 are defined in each side portion 52, 53 above the forward roof portion 48*a* and spacedly forward of strongback 63 to prevent materials from accumulating on top of the forward roof portion 48*a*. The debris scuppers 36 also provide attachment points for lifting the crusher frame 11.

A safety curtain 45 of plural lengths of rubber belt, or similar flexible material, depends from underside of the forward roof portion 48*a* inside the crusher channel 51, proximate to feed inlet 46, to prevent material from being thrown forwardly and outwardly through the feed inlet 46 by rotation of the arbor 12. Primary wear plate 50 is releasably fastened to the underside of the forward roof portion 48*a* forward of the arbor 12 providing a durable replaceable impact wear surface inside the crusher channel 51.

Deflector plates 49 extend between the first and second side portions 52, 53 spacedly above and spacedly rearward of the arbor 12 and are releasably attached to the rearward roof portion 48*b*. The deflector plates 49 absorb impacts from material being thrown upwardly and rearwardly by the rotating arbor 12 and deflect those materials downwardly behind the arbor 12. Flexible exit door 54, preferably formed of rubberized belt-type material, extends transversely across the discharge outlet 47 and depends from rearward edge of rearward roof portion 48 to help contain material, dust and debris inside the crusher frame 11 and simultaneously allow processed material to exit the crusher channel 51.

The anvil weldment channel 38 defined by the two spaced apart strongbacks 63, 64 is between the forward roof portion 48*a* and the rearward roof portion 48*b* and extends transversely between the side portions 52, 53. The anvil weldment channel 38 communicates with the crusher channel 51 spacedly above the arbor 12 and positionally maintains anvil weldment 17 therein. Plural horizontally spaced elongated holes 157 (FIG. 1) are defined in the strongbacks 63, 64 to carry threaded fasteners 153 extending therethrough and therebetween to positionally secure the anvil weldment 17 in the anvil weldment channel 38.

Figure 4:
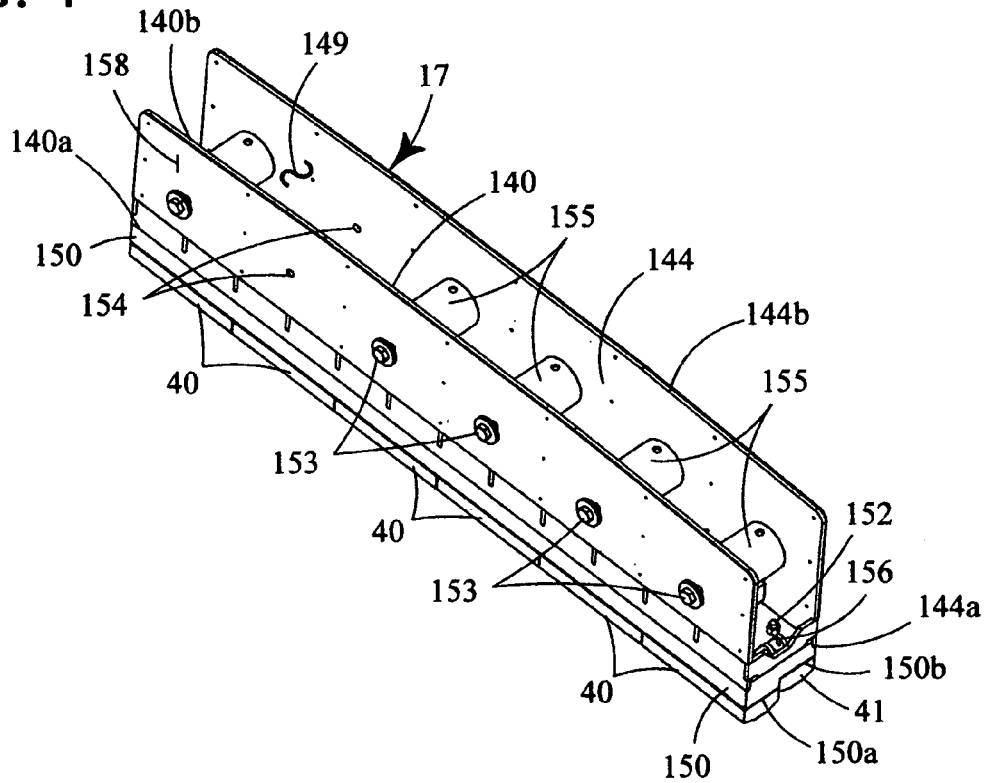
FIG. 4 is an isometric front, top and side view of the anvil weldment removed from the crusher frame.

As shown in FIG. 4 the anvil weldment 17 is formed of two parallel spaced apart inertia plates 140, 144 each having lower edge portion 140*a*, 144*a*, and an opposing upper edge portion 140*b*, 144*b*. The lower edge portions 140*a*, 144*a* of the inertia plates 140, 144 are structurally attached to top edge portion of stepped anvil block 150. Stepped anvil block 150 has two vertically spaced adjacent anvil mounting surfaces 150*a*, 150*b* on a bottom portion and defines plural spacedly arrayed vertical through holes (not shown) for releasable anvil fasteners 152 to mount anvils 40, 41 to the anvil block mounting surfaces 150*a*, 150*b*.

Figure 2:
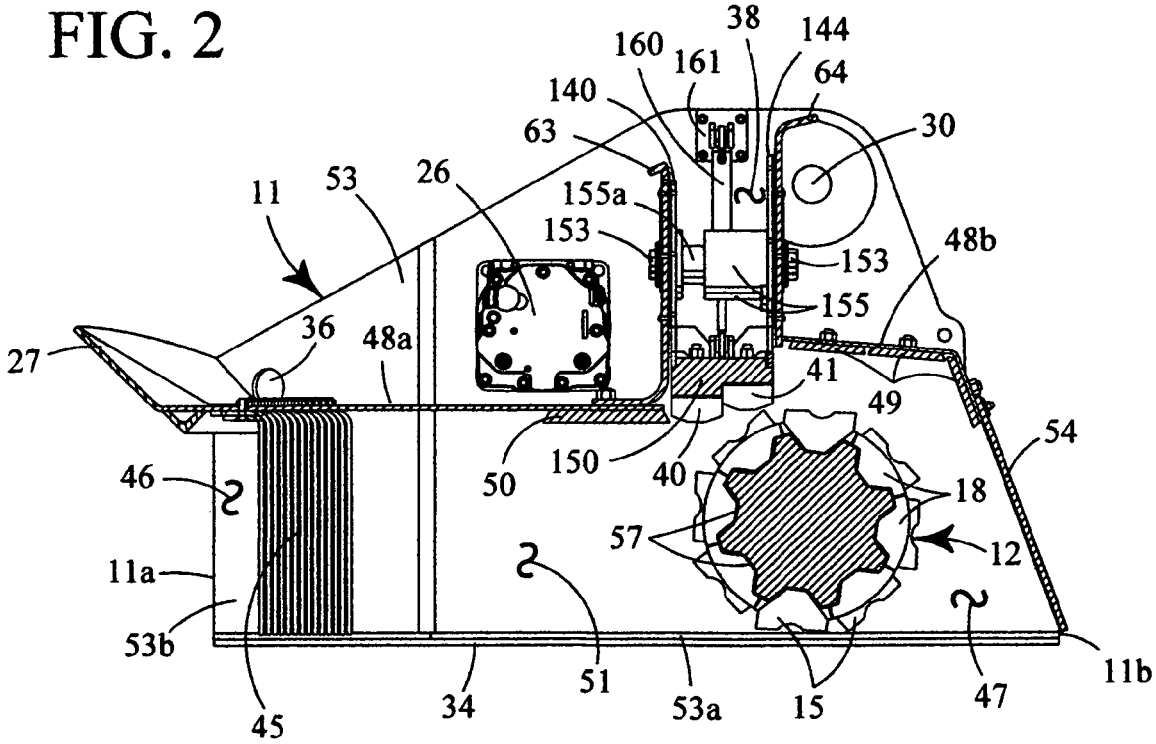
FIG. 2 is an orthographic left side cross-section view of the crusher frame taken on line 2-2 of FIG. 1 showing the anvil weldment channel, the anvil weldment carrying anvils and crushing implements on the arbor.
Figure 3:
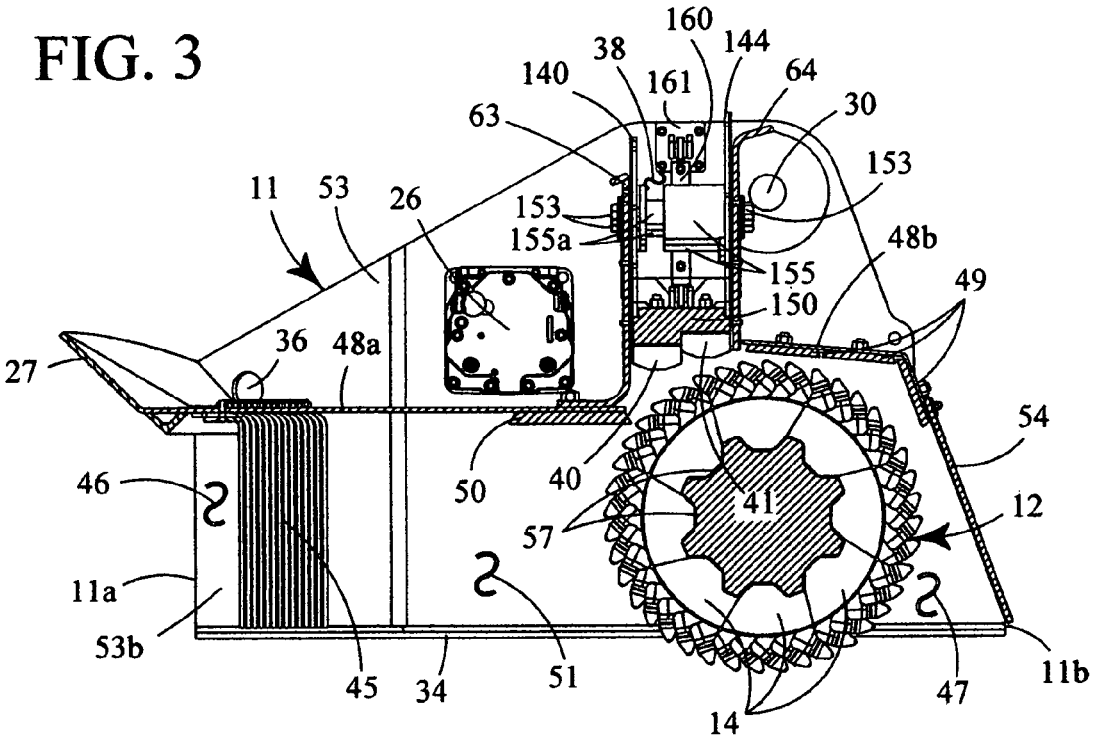
FIG. 3 is an orthographic left side cross-section view similar to that of FIG. 2 showing milling implements on the arbor extending below the skid plates and the anvil weldment retracted vertically upwardly into the anvil weldment channel.

Plural hydraulic rams 155 operatively interconnected with the hydraulic pump 23 are carried between the forward inertia plate 140 and the rearward inertia plate 144. The hydraulic rams 155 each have a piston rod 155*a* that extends and retracts axially responsive to inflow and outflow of pressurized hydraulic fluid. Each hydraulic ram 155 and each piston rod 155*a* defines an aligned axial hole (not shown) through which extends one of the threaded fasteners 153 extending through the elongated holes 157 defined in the strongbacks 63, 64 and through holes 154 defined in the inertia plates 140, 144. (FIG. 2 and FIG. 3). Extension of the piston rod 155*a* responsive to inflow of pressurized hydraulic fluid increases frictional engagement between the adjacent surfaces of the inertia plates 140, 144 and the strong backs 63, 64 to positionally secure the anvil weldment 17 in the anvil weldment channel 38. The threaded fasteners 153 extending through the strong backs 63, 64, through the inertia plates 140, 144 and through the hydraulic rams 155 reduce deflection and bending of the inertia plates 140, 144 and deflection and bending of the strongbacks 63, 64 and convert the extension forces into friction between the adjacent surfaces.

Friction enhancing panels 158 (FIG. 4) made of material having a high coefficient of surface friction such as aluminum, clutch-pad material and brake shoe material and having similar height and width dimensions as the inertia plates 140, 144 may be secured to the frictionally engaging surface portions of the inertia plates 140, 144 and of the strong backs 63, 64 to increase the surface friction therebetween upon actuation of the hydraulic rams 155.

In a second embodiment annular spacing collars (not shown) each defining an axial through hole (not shown) and are carried by the threaded fasteners 153 between the forward inertia plate 140 and the rearward inertia plate 144 adding rigidity to the anvil weldment 17 and maintaining the distance between the forward inertia plate 140 and the rearward inertia plate 144 when the threaded fasteners 153 are tightened.

The anvil weldment 17 is carried in the anvil weldment channel 38 and is positionally adjustable therein by means of hydraulic rams 160. Hydraulic ram 160 communicates between hydraulic ram mounting bracket 161 carried by each side member 52, 53 adjacent upper edge of the anvil weldment channel 38 and with ram piston mounting yoke 156 carried by the anvil block 150 spacedly inward each lateral end portion so that hydraulic ram 160 is oriented generally vertically within the anvil weldment channel 38. The threaded fasteners 153 extending through the horizontally spaced vertically elongated holes 157 defined in the strongbacks 63, 64, through aligned holes 154 defined in the inertia plates 140, 144 and extending axially through the hydraulic rams 155 prevent the anvil weldment 17 from inadvertently changing position when pressurized hydraulic fluid is not being supplied to the hydraulic rams 155.

Figure 13:
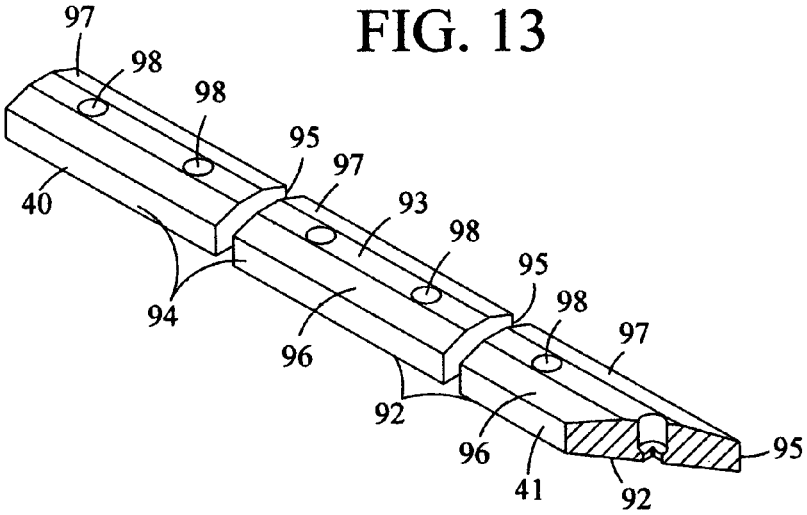
FIG. 13 is an isometric bottom, side and end view of plural anvil sections in end to end alignment.

First anvil 40 and similar second anvil 41 are releasably fastened to anvil mounting surfaces 150*a*, 150*b* of the anvil block 150 with threaded anvil fasteners 152 extending downwardly through holes (not shown) defined in the anvil block 150 to engage with recessed threaded fasteners (not shown), such as plow bolts, carried in countersunk holes 98 defined in each anvil 40, 41. (FIG. 13). The hydraulic rams 155 between the inertia plates 140, 144 are arrayed to allow access to upper end portions of the anvil fasteners 152 for removal, tightening and the like.

In the preferred embodiment, each anvil 40, 41 is comprised of plural elongate segments (FIGS. 4 and 13) fastened in end-to-end alignment on anvil mounting surface 150*a*, 150*b* of the stepped anvil block 150 and may be removed therefrom when the anvil segments 40, 41 are worn sufficiently to require rotation or replacement. As shown in FIG. 13 each anvil segment has a generally flat base portion 92, an opposing planar top portion 93, two sides 94, 95 each communicating perpendicularly with the base portion 92 along an edge and two converging angulated wear surfaces 96, 97 communicating between the top portion 93 and the sides 94, 95 opposite the base portion 92. The anvil segments 40, 41 may be removed and replaced individually when there is concentrated wear at one location due to particular tooling implement configurations.

Hydraulic motors 26 are carried by the crusher frame 11 adjacent the side portions 52, 53 proximate the upper surface of the forward roof portion 48*a* and the forward strongback 63. Each hydraulic motor 26 operatively communicates with the hydraulic pump 23 by known means and carries a rotatable drive pulley 22 laterally outward of the adjacent side portion 52, 53 on a drive shaft (not shown) extending through a hole (not shown) defined in the adjacent side portion 52, 53.

Figure 6:
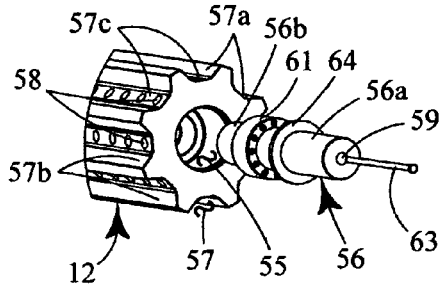
FIG. 6 is an exploded isometric view of a stub shaft and end portion of the arbor defining a stub shaft hole.

The arbor 12 is an elongate rod-like member journaled by the crusher frame 11 extending transversely across the crusher channel 51. The arbor 12 defines an axle hole 55 in each end and plural symmetrically spaced "V" shaped axial key ways 57 for radial mounting of tooling implements 13. As shown in FIG. 6, each arbor keyway 57 has two converging angulated sides 57*a*, 57*b* and a generally flat bottom 57*c*.

A stub shaft 56 (FIG. 6) is releasably carried in each axle hole 55. Each stub shaft 56 has an outer stub shaft axle 56*a* and an opposing diametrically larger stub shaft body 56*b* carrying an expansion collar 61, also known as a double-tapered locking assembly. The stub shaft body 56*b* is press fitted into the axle hole 55, and then the expansion collar 61 is placed on the stub shaft axle 56*a* and fitted into the axle hole 55. The expansion collar 61 mechanically expands radially and prevents rotation of the stub shaft body 56*b* within the axle hole 55 and enables the arbor 12 to be operated in forward and reverse directions without the risk of the stub shaft 56 disengaging from the arbor 12. The expansion collars 61 also prevent concentrated wear at any one portion of the arbor 12 as would occur if the stub shaft 56 was threadably engaged with the arbor 12 and allow the arbor 12 to be turned end-for-end to increase useful life.

An axial through hole 59 is defined in each stub shaft 56 communicating between opposing end portions to release trapped air as the stub shaft body 56*b* is press-fitted into the axle hole 55. Injecting high-pressure grease into the hole 59 assists removal of the stub shaft body 56*b* and expansion collar 61 from the axle hole 55. An elongate threaded fastener 63, such as a bolt, is inserted into the axial through hole 59 which has a radially reduced shoulder (not shown) proximate inner end portion to threadably engaged with a threaded axial hole (not shown) defined in the arbor 12 inside of axle hole 55. The threaded fastener 63 ensures the stub axle 56 is completely seated inside the axle hole 55 before the expansion collar 61 is expanded. Annular sealing ring 64 fits over of the stub shaft axle 56*a* and protects outer surface of the expansion collar 61 from debris.

As shown in FIG. 1, the stub shaft axles 56*a* rotate in bearings (not shown) carried by the arbor bearing mounts 33 on the first and second side portions 52, 53 of the crusher frame 11. A slave pulley 44 is carried on each stub shaft axle 56*a* outward of the bearing mounts 33.

Drive belt 21 communicates between the drive pulley 22 and the slave pulley 44 to transfer rotational motion of the drive pulley 22 to the arbor 12. Idler pulleys 43 keep the drive belt 21 in position. Ventilated belt guards 35 (FIG. 14) releasably fastened to each side portion 52, 53 over and about the slave pulleys 44, drive pulleys 22 and drive belts 21 prevent foreign materials and foreign objects from becoming entangled therein.

A control panel 99, that may be carried within operator cab of the carrying vehicle 100, is operatively connected to the engine 28, the hydraulic pump 23 and the hydraulic motors 26 enables the operator to control operation of the power pack 10 and the arbor 12 and the canting mounting structure 17.

As shown in FIGS. 9 through 12, the various tooling implements 15, 14, 18 have distinct configurations and are each specialized for a particular use. Each tooling implement 13 has a similar base portion 60 configured for radial mounting and automatic centering within an arbor keyway 57 and an opposing head portion suited for a particular use. Each base portion 60 has a generally flat bottom 60*a* and two diverging angulated sides 60*b*, 60*c* forming a truncated inverted pyramid that engages within the "V" shaped arbor key ways 57 to be radially supported therein and automatically centered therein by the converging keyway sides 57*a*, 57*b*.

Holes 74 are defined in each tooling implement 13 each hole 74 having an enlarged counterbore 75 communicating with tooling implement head portion to carry a head portion (not shown) of a threaded releasable fastener (not shown) such as a bolt. The releasable fasteners (not shown) extend through the holes 74 defined in the tooling implement 13 and engage with one of the spacedly arrayed radial threaded holes 58 defined in the base portions 57*c* of the arbor keyways 57.

Figure 9:
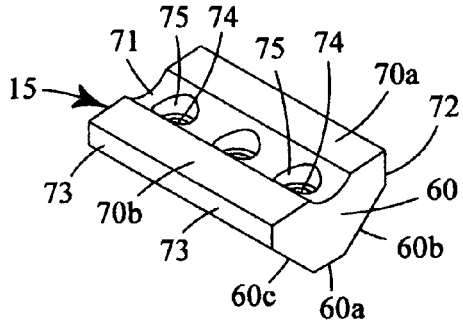
FIG. 9 is an isometric top, side and end view of a crushing implement.

As shown in FIG. 9, head portion of crushing implement 15 has a first top portion 70*a* and a second top portion 70*b* and a defines a longitudinally aligned concave depression 71 therebetween. A first striking side 72 interconnects the first top portion 70*a* and one base angulated side 60*b*. Similarly, a second striking side 73 interconnects the second top portion 70*b* and second base angulated side 60*c*. The second striking side 73 may be utilized by rotating the crushing implement 15 end-for-end on the arbor 12 after the first striking side 72 has worn sufficiently to require replacement. Alternatively, the second striking side 73 may be used by reversing rotation of the arbor 12. The concave depression 71 allows the crushing implement 15 to endure wear while maintaining a small surface area over which impact forces are concentrated to increase crushing forces exerted thereby. As noted previously, adjusting the vertical position of the anvil weldment 39 relative to the arbor 12 by actuating the hydraulic rams 160 can further increase the useful life of each striking side 72, 73. Adjusting the vertical position of the anvil weldment 17 permits mechanical compensation for wear of the tooling implements a 13.

Figure 10:
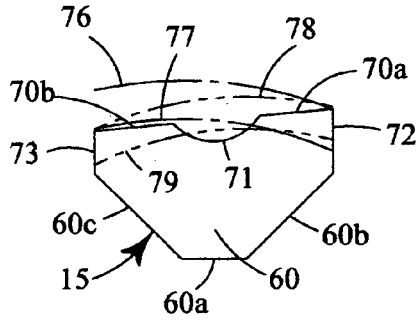
FIG. 10 is an enlarged orthographic end view of the crushing implement of FIG. 9 showing forward and reverse wear patterns.

As shown in FIG. 10, dashed line 76 shows the travel path of the first striking side 72 of an unworn crushing implement 15. Dashed line 77 shows the travel path of the first striking side 72 after being worn sufficiently to be reversed. Dashed line 78 shows the travel path of the unworn second striking side 73 after the crushing implement 15 has been reversed end-for end. Dashed line 79 shows the travel path of a fully worn crushing implement 15 that needs to be replaced.

Figure 8:
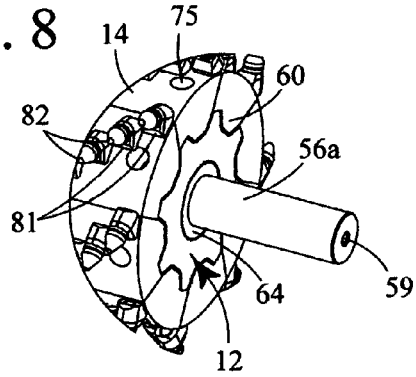
FIG. 8 is an enlarged end view of the arbor of FIG. 7 showing the interlocking configuration of the adjacent edge portions of adjacent milling implements.
Figure 7:
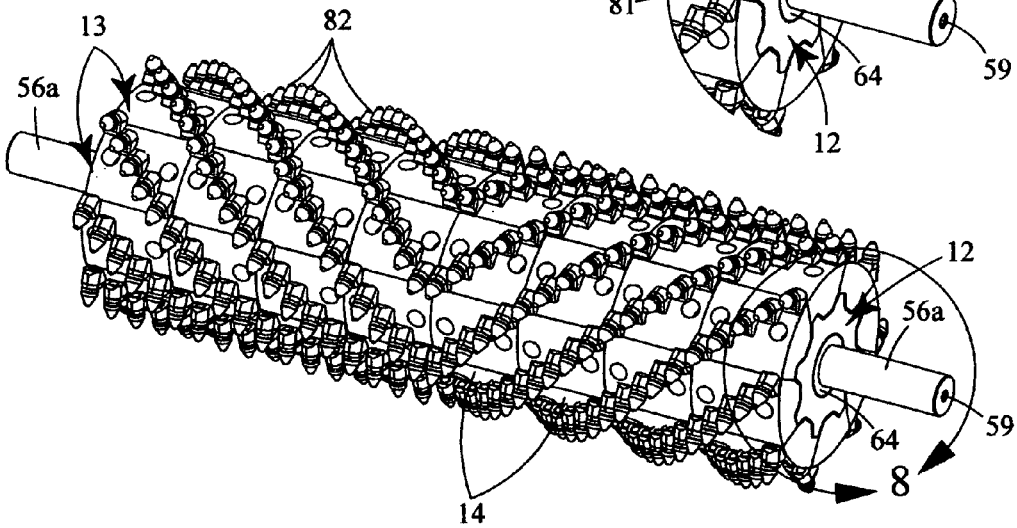
FIG. 7 is an isometric view of the arbor encased in plural milling implements arranged in plural inside out helical patterns.
Figure 12:
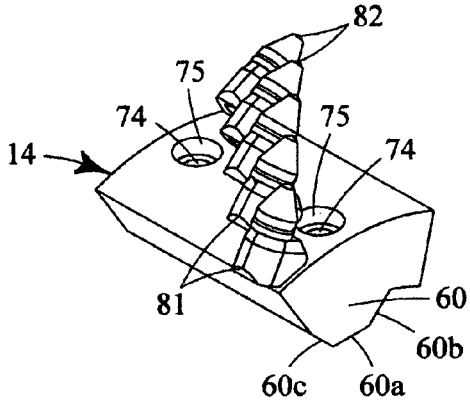
FIG. 12 is an isometric top, side and end view of a milling implement for concrete and bedrock having plural spaced diagonally staggered conical grinding tips.

FIG. 12 shows a milling implement 14 for asphalt, concrete and bedrock having a similar base portion 60 and an opposing head portion structurally carrying plural spaced diagonally staggered tooth bases 81. Each tooth base 81 defines a medial channel (not shown) to carry a shaft portion (not shown) of a conical carbide grinding tooth 82 therein. As shown in FIG. 7 and FIG. 8, when mounted on the arbor 12 adjacent edge portions of adjacent milling implements 14 cooperatively and frictionally engage with each other to disperse shearing forces to add structural integrity to the milling implement 14 configuration.

Figure 11:
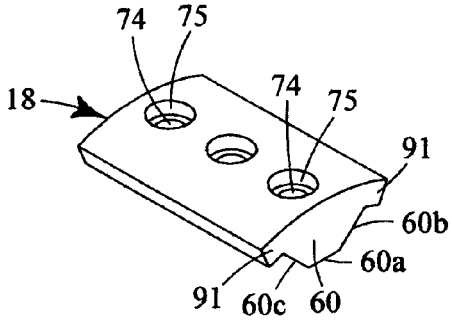
FIG. 11 is an isometric top, side and end view of an arbor protecting implement.

FIG. 11 shows an arbor protector implement 18 having a similar base portion 60 configured for carriage in and automatic centering in an arbor keyway 57. Arbor protector head portion opposite the base 60 is generally arcuate and opposing side extensions 91 protect circumferential surfaces of the arbor 12 not otherwise protected by tooling implements 13. Arbor protection implements 18 are used in conjunction with crushing implements 15 (FIG. 5) and may also be used in conjunction with milling implements 14. (Not shown).

Having described the structure of our portable rock crusher and scarifier, its operation may be understood.

The power pack 10 is releasably attached to the crusher frame 11 by aligning the holes 30 defined in the power pack frame side portions 25*a*, 25*b* and the holes 30 defined in the side portions 52, 53 of the crusher frame 11 and installing releasable fasteners 32 therethrough. The hydraulic cylinders 19 communicating between the crusher frame 11 and the power pack frame 25 side portions 25*a*, 25*b* are interconnected and the appropriate hydraulic connections are made. The carrying vehicle 100 is positioned adjacent behind the primary frame 110 of the canting mounting structure 16 so that the carrying vehicle mounts 117 may be releasably connected to the carrying vehicle 100 by known means. Hydraulic and other operative connections are made so that the portable rock crusher and scarifier 9 and its functions may be controlled by the operator using the control panel 99 within the operator cab of the carrying vehicle 100.

The on-site and in-situ materials to be recycled, reclaimed, planed, milled or crushed are examined to determine the appropriate type of tooling implement 13 to install on the arbor 12.

Loosened rocky materials in linear piles, also known as windrows, are most effectively reduced "dry" with plural spacedly arrayed crushing implements 15 (FIG. 9) rotating at approximately 4500 feet per minute tip speed. Paternation of the crushing implements 15 is commonly inside out and the rotation of the arbor 12 is upward. (Clockwise as viewed in FIG. 2).

The carrying vehicle 100 is operated to lift the portable rock crusher and scarifier 9 vertically to a height sufficient for an operator to access the arbor 12 and tooling implements 13 thereon. Hydraulic cylinders 19 may also be actuated to rotate the forward end portion 11*a* of the crusher frame 11 upwardly (FIG. 15). Known safety lock-outs (not shown) and bracing (not shown) may be used to ensure the lifted portable rock crusher and scarifier 9 does not fall upon the operator. As shown in FIG. 15, the rearward end portion 11*b* of the crusher frame 11 may also be rested upon supporting ground surface 29 to further decrease the risk of the portable rock crusher and scarifier 9 falling upon an operator.

Figure 5:
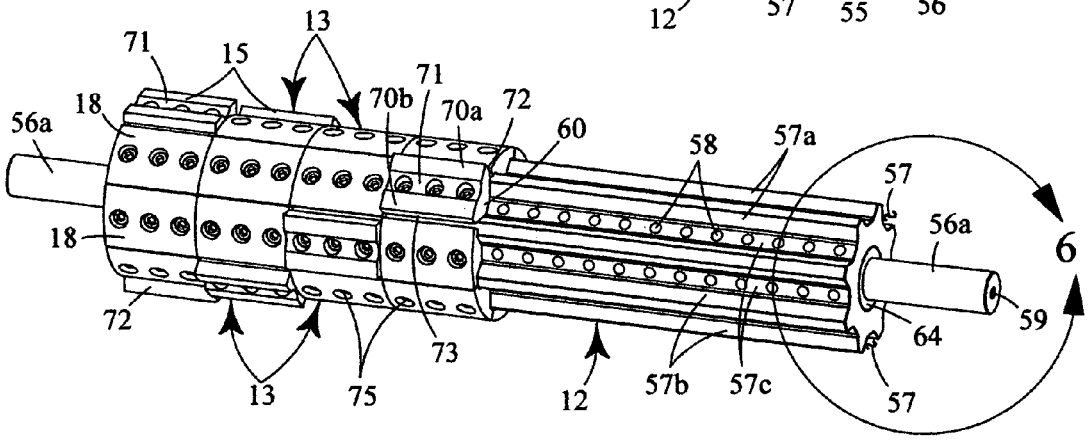
FIG. 5 is an isometric view of the arbor showing one half of the arbor carrying an array of crushing implements and arbor protecting implements, and the opposing half of the arbor void of tooling implements showing the symmetrically spaced "V" shaped keyways.

The arbor 12 is visually inspected for damage and wear. Any debris within the keyways 57 is removed and a plurality of crushing implements 15 are installed on the arbor 12 in the keyways 57 in the configuration that is appropriate to the material being crushed, recycled and reclaimed. Threaded fasteners (not shown) inserted into and through the holes 74 defined in each crushing implement 15 engage in the threaded radial holes 58 defined in the keyways 57. The threaded fasteners (not shown) are tightened so that the head portions (not shown) fit into the counterbores 75 defined in the crushing implement 15 head portion. Arbor protector implements 18 are similarly installed to protect those portions of the arbor 12 not carrying crushing implements 15. (FIG. 5).

The position of the anvils 40, 41 relative to the crushing implements 15, is adjusted to provide rotational clearance and to regulate the size of crushed product output. Pressurized hydraulic fluid inflow to hydraulic rams 155 is interrupted to reduce the surface friction between the adjacent surfaces of the strongbacks 63, 64 and the inertia plates 140, 144 and the aluminum panels 158 carried thereon. Hydraulic rams 160 are actuated to move the anvil weldment 17 vertically upwardly and downwardly within the anvil weldment channel 38 as desired. Pressurized hydraulic fluid is then reapplied to the hydraulic rams 155 to increase the surface friction between adjacent surfaces of the strong backs 63, 64, the inertia plates 140, 144 and the aluminum panels 158 carried thereon effectively locking the anvil weldment 17 in position.

A road grader or similar road maintenance vehicle is used to gather rocks and gravel and similar material from the road surface and from barrow pits on either side of the roadway and deposit the materials in a linear windrow on the roadbed. Additional material to be crushed may also be deposited on the roadway by dump trucks and the like.

The engine 28 is started using the control panel 99 in the operator cab of the carrying vehicle 100. The rock crusher and scarifier 9 is thereafter moved forwardly along the windrow by the carrying vehicle 100 with the windrow material entering the feed inlet 46. Forward movement along the windrow creates a wall of material to be crushed inside the crusher frame 11 immediately forward of the arbor 12. The most efficient rotational speed for the arbor 12 is dictated by the type of material being recycled and reclaimed and is adjusted by the operator using the control panel 99.

As the arbor 12 rotates, the crushing implements 15 repeatedly strike and cut into proximate side of the material wall (not shown) while additional material is simultaneously added to the distal side of the material wall. This action "force feeds" the rock crusher and scarifier 9 ensuring substantially continuous contact between the proximate side of the material wall and the crushing implements 15 on the arbor 12 wherein impact shock is transferred forwardly from the arbor 12 through the rocky material causing rock versus rock collisions. Rotation of the arbor 12 also causes tumbling of the rocky material generating additional rock versus rock collisions.

Material too large to pass between the crushing implements 15 and the primary wear plate 50 and between the crushing implements 15 and the anvils 40, 41 is fractured into smaller pieces as it wedges between the rotating and stationary surfaces. Material small enough to pass between the crushing implements 15 and the primary wear plate 50 and between the crushing implements 15 and the anvils 40, 41 is moved by the rotation of the arbor 12 to a rear portion of the crusher frame 11 whereupon the material may strike the deflector plates 49 and thereupon fall onto the supporting surface and exit the crusher frame 11 through the discharge outlet 47 and under the flexible exit door 54. Thereafter, the material may be handled as desired, such as being further dispersed upon the roadbed.

An alternative to the crushing implements 15 is milling implements 14 for grinding and milling asphalt, bedrock and concrete. Milling implements 14 have a greater vertical dimension than crushing implements 15 and require retraction of the anvil weldment 17 into the anvil weldment channel 38 to provide clearance for the arbor 12 rotation. (FIG. 3) The greater vertical dimension of the milling implements 14 allows grinding of surfaces below skid plates 34 of the crusher frame 11. Depending upon the type and character of the material to be milled and planed, the direction of arbor 12 rotation may also be reversed.

Loosened bituminous and cement type material may be pulverized wet with crushing implements 15 rotating at approximately 4000-5000 feet per minute tip speeds. Patternation of the crushing implements 15 is commonly multi-helical inside out.

Firm, in place sections of solid asphalt, bedrock, concrete and the like are effectively milled with milling implements 14 rotating in either an upward or downward direction at approximately 1000 to 2000 feet per minute tip speed. Milling implements 14 may also be used for preparation of roadbeds.

When operated in a stationary configuration (FIG. 16, FIG. 17) the portable rock crusher and scarifier 9 is connected to a base 101 which may include a known grizzly (not shown) that screens and separates material exiting the discharge outlet 47. Prior to fastening the crusher frame 11 to the base 101, it may be necessary to attach a planar bottom plate (not shown) to the crusher frame 11 to extend laterally between the first and second side portions 52, 53, and elongately between the forward end portion 11*a* and the rearward end portion 11*b*. Attachment of the bottom plate (not shown) may require removal of the skid plates 34. Alternatively, such planar bottom plate (not shown) may be integrated into the base 101 eliminating the need to separately attach the bottom plate to the crusher frame 11.

Figure 17:
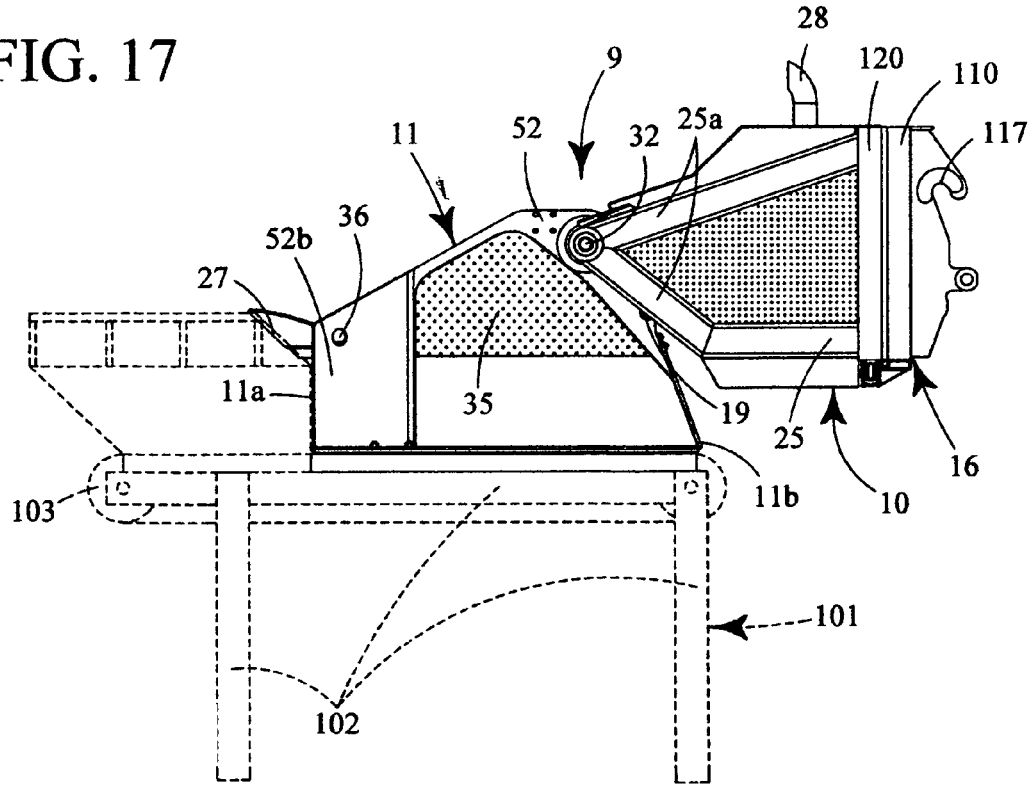
FIG. 17 is an orthographic left side view of the power pack and crusher frame supported on a base for stationary operation with a conveyor feed assembly.

The base 101 is formed of plural structurally interconnected box beams 102 and may releasably support the portable rock crusher and scarifier 9 spacedly above the supporting ground surface with the crusher frame 11 positioned angularly relative to the power pack 10 and base 101 so that the feed inlet 46 is positioned higher than the discharge outlet 47. (FIG. 16) Gravity acting upon the material entering the feed inlet 46 supplies the necessary "force feeding" for efficient operation. Materials to be crushed may also be fed into the feed inlet 46 by means of a conveyor assembly 103. (FIG. 17). Conveyor feed more accurately mirrors the feeding process that occurs when the portable rock crusher and scarifier 9 is moved forwardly along a windrow of material by a carrying vehicle 100.

The foregoing description of our invention is necessarily of a detailed nature so that a specific embodiment of a best mode may be set forth as is required, but it is to be understood that various modifications of details, and rearrangement, substitution and multiplication of parts may be resorted to without departing from its spirit, essence or scope.

We claim:

1. An improved portable rock crusher and scarifier having a crusher frame defining a feed inlet at a forward end portion, a discharge outlet at a rearward end portion and a crusher channel extending there between journaling a rotatable arbor carrying plural tooling implements for comminuting, recycling and reclaiming road construction materials, and a power pack operatively interconnected with the rotatable arbor, the improvements comprising in combination:

an anvil weldment channel defined by two parallel spaced apart strongbacks structurally carried by the crusher frame, the anvil weldment channel communicating with the crusher channel proximate the rotatable arbor;

an anvil weldment adjustably carried within the anvil weldment channel, the anvil weldment having, two parallel spaced apart inertia plates, each inertia plate having a bottom edge portion structurally attached to a top edge portion on an anvil block;

an anvil releasably attached to the anvil block opposite the inertia plates;

plural symmetrically spaced axial keyways defined in the rotatable arbor for releasable carriage of the plural tooling implements, each keyway defining plural spacedly arrayed threaded radial holes for releasable fasteners to secure the plural tooling implements in the keyways;

the plural tooling implements releasably attachable to the rotatable arbor, each tooling implement having a head portion, an opposing base portion for engagement in a keyway, and at least one through hole for a releasable fastener extending therethrough;

an engine and an operatively interconnected hydraulic pump carried by the power pack;

two hydraulic motors operatively communicating with the hydraulic pump, each hydraulic motor carrying a rotatable drive pulley; and a drive belt communicating between the drive pulley and a slave pulley carried at each end of the rotatable arbor to transfer rotational motion of the drive pulley to the rotatable arbor.

2. The portable rock crusher and scarifier of claim 1 further comprising:

a power pack frame carrying the power pack, the power pack frame having two spaced apart side portions structurally connected to a back portion, each spaced apart side portion defining a hole in an end portion opposite the back portion for a releasable fastener to releasably engage with the crusher frame.

3. The portable rock crusher and scarifier of claim 1 further comprising:

a stub shaft releasably carried in an axle hole defined in each end of the rotatable arbor;

each stub shaft having a stub shaft axle at one end portion, a stub shaft body carrying an expansion collar at the opposing end portion, and defining an axial through hole therebetween; and the stub shaft body and the expansion collar engage within the axle hole defined in the arbor to enable reversible arbor rotation.

4. The portable rock crusher and scarifier of claim 1 further comprising:

a hydraulic ram to adjustably position the anvil weldment within the anvil weldment channel, the hydraulic ram operatively connected with the hydraulic pump and communicating between a hydraulic ram mounting bracket carried by the crusher frame within the anvil weldment channel and a hydraulic ram mounting carried by the anvil block between the inertia plates.

5. The portable rock crusher and scarifier of claim 1 further comprising:

a hydraulic ram operatively connected with the hydraulic pump, the hydraulic ram having a body frictionally communicating with one inertia plate and a hydraulic ram piston rod axially movable within the hydraulic ram body frictionally communicating with the second spaced apart inertia plate, the body and the hydraulic ram piston rod each defining an axially aligned through hole;

aligned pairs of vertically elongated holes defined in the strongbacks and aligned pairs of holes defined in the two spaced apart inertia plates;

threaded fasteners extending through the aligned pairs of vertically elongated holes defined in the strongbacks and the aligned pairs of holes defined in the two spaced apart inertia plates and through the axial through hole defined in the hydraulic ram body and the hydraulic ram piston rod to positionally secure the hydraulic ram perpendicularly between the two spaced apart inertia plates and to positionally secure the anvil weldment inside the anvil weldment channel when pressurized hydraulic fluid is supplied to the hydraulic ram.

6. The portable rock crusher and scarifier of claim 5 further comprising:

friction enhancing panels carried on the frictionally engaging immediately adjacent surfaces of the inertia plates and the strong backs to enhance frictional engagement between the strongbacks and the inertia plates.

7. The portable rock crusher and scarifier of claim 1 further comprising:

a canting mounting structure for canting the crusher frame and power pack relative to a carrying vehicle, the canting mounting structure having, a primary frame with spaced apart top and bottom edge portions and spaced apart opposing side portions, each side portion communicating with the spaced apart top and bottom edge portions, reinforcing beams communicating with the top and bottom edge portions and opposing side portions, the reinforcing beams carrying a hub medially between the spaced apart top and bottom edge portions and medially between the opposing side portions, an axle carried by the medial hub, the axle extending forwardly from the primary frame perpendicular to the top and bottom edge portions and perpendicular to the opposing side portions, and vehicle carrying mounts for releasable attachment to a carrying vehicle structurally connected to the top and bottom edge portions opposite the axle;

a secondary frame attachable to the power pack and rotatably attached to the primary frame, the secondary frame having spaced apart top and bottom edge portions and spaced apart opposing side portions, each side portion communicating with the spaced apart top and bottom edge portions, reinforcing beams communicating with the top and bottom edge portions and opposing side portions, the reinforcing beams carrying a hub medially between the top and bottom edge portions and medially between the opposing side portions, the hub rotatably engaged with the axle;

a hydraulic cylinder operatively communicating with the hydraulic pump to pivot the secondary frame relative to the primary frame about the axle, the hydraulic cylinder having, a body and an axially movable hydraulic cylinder rod, one end portion of the hydraulic cylinder pivotally connected to the primary frame and the opposing end portion of the hydraulic cylinder pivotally connected to the secondary frame.

8. The portable rock crusher and scarifier of claim 2 further comprising:

a hydraulic cylinder operatively connected with the hydraulic pump to pivot the crusher frame relative to the power pack, the hydraulic cylinder having a body and a hydraulic cylinder rod, one end portion of the hydraulic cylinder pivotally interconnected with one side portion of the power pack frame, and the opposing end portion of the hydraulic cylinder pivotally interconnected with the crusher frame.

9. The portable rock crusher and scarifier of claim 1 wherein:

the symmetrically spaced axial keyways defined in the arbor are "V" shaped with inwardly angulated side portions and a flat bottom portion; and the base portion of each tooling implement has opposing converging sides between the head portion and a planar bottom to automatically center the tooling implement within an axial keyway.

10. The portable rock crusher and scarifier of claim 1 wherein:

the anvil block has a bottom portion with two vertically spaced parallel adjacent anvil mounting surfaces for mounting anvils thereon; and each anvil comprises plural similar segments releasably fastened in end-to-end alignment to one anvil mounting surface.

11. The portable rock crusher and scarifier of claim 1 further comprising:

a plurality of arbor protector implements releasably carried by the rotatable arbor in spaced array amongst the tooling implements, each arbor protector implement having a base portion for carriage in a keyway and a head portion with side extensions that extend over and protect adjacent circumferential surfaces of the rotatable arbor; and through holes defined in each arbor protector implement to carry a threaded releasable fastener extending through the arbor protector implement and engaging with one of the spacedly arrayed radially threaded holes defined in the arbor keyway.

12. The portable rock crusher and scarifier of claim 1 wherein:

the tooling implement is a crushing implement having a first top portion and a second top portion defining a concave depression there between;

a first striking side interconnects the first top portion and one base angulated side and a second striking side interconnects the second top portion and a second base angulated side; and the base angulated sides communicate with opposing edge portions of the base portion.

13. The portable rock crusher and scarifier of claim 1 wherein:

the tooling implement is a milling implement for asphalt and bedrock having a head portion carrying plural spacedly arrayed tooth bases, each tooth base defining a channel to carry a shaft portion of a conical grinding tooth.

14. The portable rock crusher and scarifier of claim 11 wherein:

each tooling implement has a side portion between the head portion and the base portion that frictionally engages with a side portion of adjacent tooling implement on the arbor to disperse shearing forces and to add structural integrity to the tooling implement configuration.

15. The portable rock crusher and scarifier of claim 12 wherein:

the crushing tooling implements can be reversed end-for-end on the rotatable arbor to increase useful life of the crushing implement.

16. The portable rock crusher and scarifier of claim 1 wherein:

the crusher frame and power pack are releasably mountable to a base for stationary operation, the base having plural interconnected box beams supporting the crusher frame above a supporting surface in an angulated orientation with the feed inlet vertically higher than the discharge outlet, and material deposited into the feed inlet moves by force of gravity into contact with the rotatable arbor.

17. The portable rock crusher and scarifier of claim 1 wherein:

the crusher frame and power pack are releasably mountable to a base for stationary operation, the base having plural interconnected box beams supporting the crusher frame above a supporting surface and supporting a conveyor for moving material into the feed inlet and into contact with the rotatable arbor.

18. The portable rock crusher and scarifier of claim 1 wherein:

the crusher frame is releasably mountable to a carrying vehicle spaced apart from the power pack; and the power pack is releasably mountable to the carrying vehicle spaced apart from the crusher frame.

* * * * *